US007568888B2

(12) United States Patent
Castillo

(10) Patent No.: US 7,568,888 B2
(45) Date of Patent: Aug. 4, 2009

(54) FAN BLADES HAVING VARIABLE PITCH COMPLIANTLY RESPONSIVE TO A LINEAR ACTUATOR

(75) Inventor: Brian V. Castillo, Royal Oak, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 473 days.

(21) Appl. No.: 11/552,223

(22) Filed: Oct. 24, 2006

(65) Prior Publication Data

US 2008/0095627 A1 Apr. 24, 2008

(51) Int. Cl.
*B64C 11/06* (2006.01)

(52) U.S. Cl. ..... 416/143; 416/151; 416/155; 416/168 R; 416/169 A

(58) Field of Classification Search ..... 416/143, 416/151, 155, 162, 168 R, 169 A
See application file for complete search history.

(56) References Cited

U.S. PATENT DOCUMENTS 2,626,766 A * 1/1953 McDonald ..... 416/168 R
3,246,862 A * 4/1966 Culver et al. ..... 416/162
3,729,272 A * 4/1973 Lemont ..... 416/168 R
4,880,402 A * 11/1989 Muller ..... 416/162
5,096,381 A * 3/1992 Svenning ..... 416/168 R
5,205,712 A * 4/1993 Hamilton ..... 416/155
6,071,076 A * 6/2000 Ansari et al. ..... 416/168 R
6,109,876 A 8/2000 Schreiber
6,422,816 B1 7/2002 Danielson
6,991,426 B2 1/2006 Pietricola
7,134,840 B2 * 11/2006 Vogel ..... 416/155

* cited by examiner

*Primary Examiner*—Igor Kershteyn

(57) ABSTRACT

A variable pitch fan blade mechanism, particularly well suited for automotive applications, wherein the blade pitch is compliantly responsive to selective actuation of a linear actuator. A linear actuator is disposed in the fan shaft composed of an electric drive component drivingly engaged with a follower component, a set of fan blades resiliently attached to a head of the follower component, and a push assembly connected to the fan shaft composed of a push plate and a plurality of push rods, one push rod for each fan blade. Each push rod engages its respective fan blade adjacent an edge thereof. The fan blades are resiliently biased toward the push rods such that axial movement of the push rods in response to actuation of the linear actuator results in compliant changes of pitch of the blades.

14 Claims, 4 Drawing Sheets

FAN BLADES HAVING VARIABLE PITCH COMPLIANTLY RESPONSIVE TO A LINEAR ACTUATOR

TECHNICAL FIELD

The present invention relates to fans, and more particularly variable pitch fan blades. Still more particularly, the present invention relates to variable pitch fan blades in which the blade pitch is compliantly responsive to selective actuation of a linear actuator.

BACKGROUND OF THE INVENTION

In automotive applications, the motor vehicle includes one or more cooling fans and one or more heat exchangers (i.e., one each for the engine cooling system, the transmission, the air conditioning, and electrical components) which are mounted to the front of the motor vehicle, wherein the one or more fans provides a stream of forced air through the fins of the one or more heat exchangers.

As shown by way of example at FIG. 1, a fan assembly 10 includes two fans 12, 14, each having fixed pitch blades 16. The fans 12, 14 are typically driven mechanically by the engine, either by the crankshaft or by a belt-driven accessory pulley spinning at engine speed, wherein electro-viscous clutch mechanisms are commonly employed to selectively disable the fan (these clutch mechanisms can incur viscous friction and energy loss to heat), or alternatively each fan is powered electrically, wherein the electric motor rotational speed may be either preset or variable.

Under various driving conditions, more or less fan forced air flow is necessary. For example, a large amount of fan forced air is required, as for example on hot days when the motor vehicle is running but stopped or is traveling slowly, towing or traveling on an upgrade. On the other hand, little or no fan forced air is necessary on cold days when the motor vehicle is traveling at high speed. Most driving conditions are between these two extremes, wherein it would be desirable for the fan forced air to adjust to the driving conditions so as to always provide an optimal air flow with the least amount of energy consumption to drive the one or more fans.

Variable pitch blades are known for fixed wing aircraft propellers and helicopter rotors. However, these applications involve complex and necessarily robust mechanisms that are unsuitable for fans of the type presently being considered, where minimization or elimination in parasitic loss is an important consideration.

What remains needed in the art is a simple and lightweight mechanism for adjusting fan pitch, which is particularly suited to automotive application.

SUMMARY OF THE INVENTION

The present invention is a variable pitch fan blade mechanism, particularly well suited for automotive applications, wherein the blade pitch is compliantly responsive to selective actuation of a linear actuator such that parasitic energy loss is minimized or eliminated.

The variable pitch fan blade mechanism according to the present invention includes a fan shaft; a linear actuator disposed in the fan shaft, being composed of an electric drive component drivingly engaged with respect to a follower component; a set of fan blades resiliently attached to a head of the follower component; and a push assembly connected to the fan shaft composed of a push plate and a plurality of push rods, one push rod, respectively, for each fan blade. Each push rod engages its respective fan blade adjacent an edge thereof. The fan blades are resiliently biased toward the push rods such that axial movement of the push rods results in compliant changes of pitch of the blades.

A preferred electric drive component is an electric motor having a threaded motor shaft which threadingly engages a threaded bore of the follower component, wherein the follower component is axially splined with respect to the fan shaft. Electricity from an external source is delivered to the electric drive component, as for example by a ring and brush contact arrangement disposed on the fan shaft.

In operation, the fan shaft is rotatably driven by any conventional modality, such as a belt or direct drive with respect to an external engine or motor. Selective actuation of the electric motor results in threading of the threaded motor shaft with respect to the threaded bore, wherein, depending upon the direction of rotation of the threaded motor shaft, the follower axially moves toward or away from the electric motor, slidably on the splines. As a consequence of this axial movement of the follower component, the push rods cause either more or less resilient tilting of the blades so as to thereby compliantly change the blade pitch.

Accordingly, it is an object of the present invention to provide a variable pitch fan blade mechanism, particularly well suited for automotive applications, wherein the blade pitch is compliantly responsive to selective actuation of a linear actuator such that parasitic energy loss is minimized or eliminated.

This and additional objects, features and advantages of the present invention will become clearer from the following specification of a preferred embodiment.

DESCRIPTION OF THE PREFERRED EMBODIMENT

Figure 1:
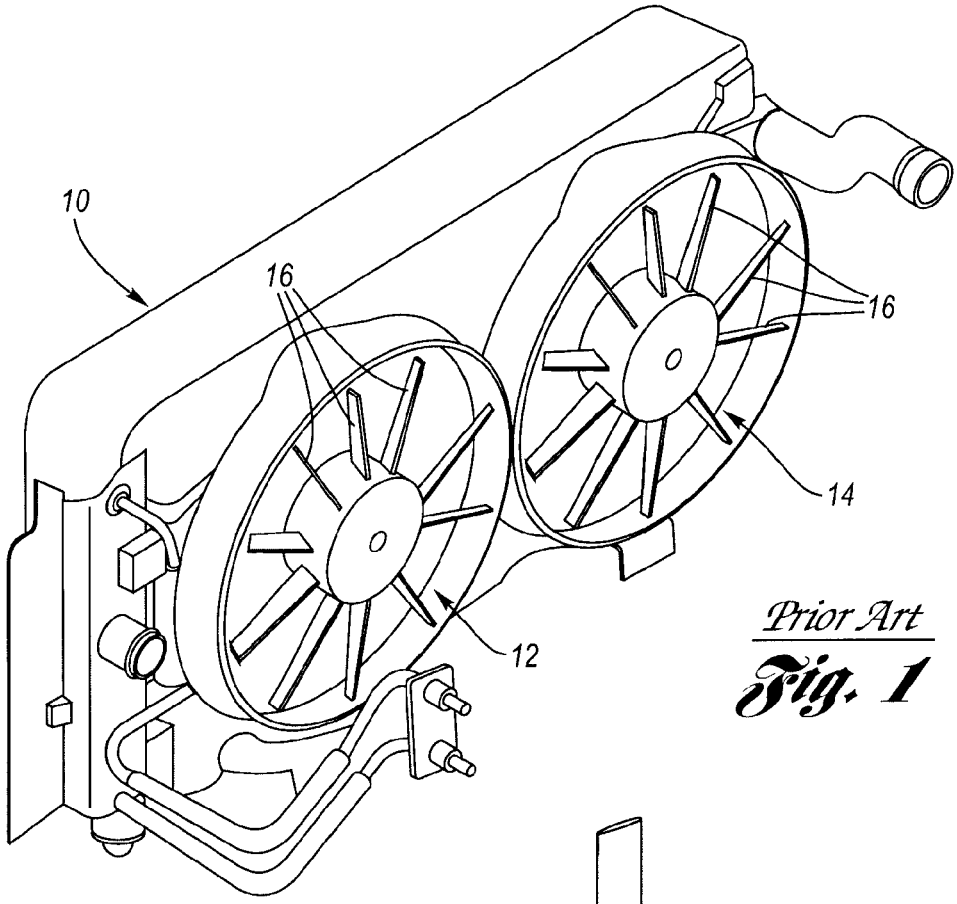
Prior Art Fig. 1
FIG. 1 is a perspective view of a prior art fan assembly of the type used for automotive applications.

Referring now to the Drawing, FIGS. 2 through 6 depict a preferred embodiment of the variable pitch fan blade mechanism 100 according to the present invention.

Figure 2:
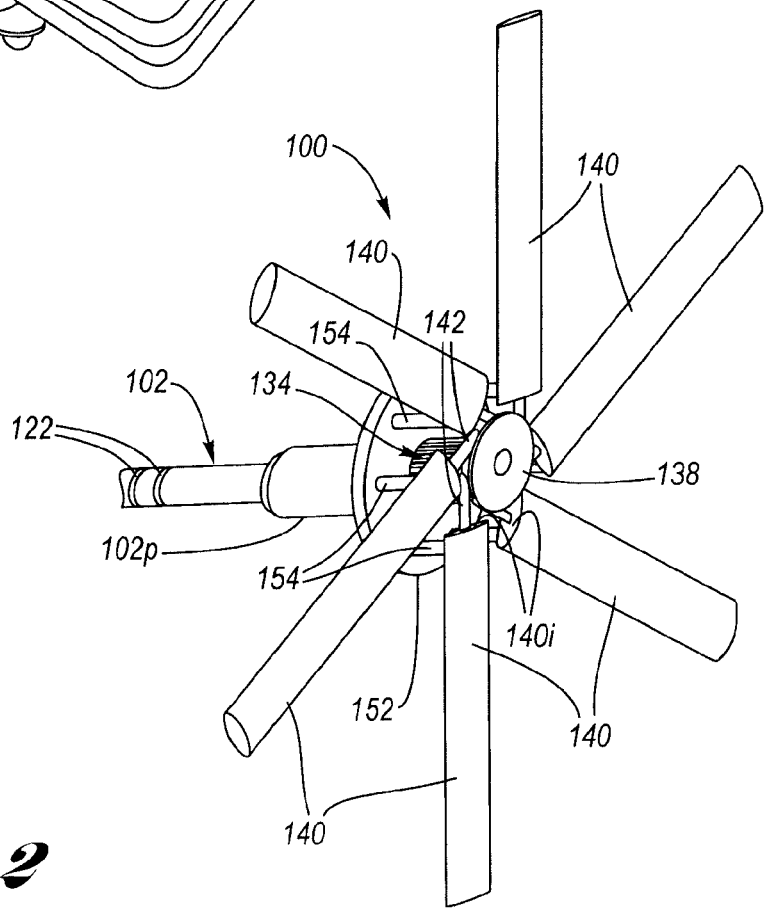
FIG. 2 is a perspective view of a variable pitch fan blade mechanism according to the present invention.

With initial reference to FIGS. 2 through 3A, the variable pitch fan blade mechanism 100 includes a fan shaft 102 which is connected distally (not shown) to a conventional bearing and is driven conventionally, as discussed hereinabove. A proximal end portion 102*p* of the fan shaft 102 is configured to provide an axially aligned motor receptacle 104 and a communicating follower receptacle 106 having a sidewall 108 provided with a plurality of axially aligned splines 110. A drive component 112, composed, by way of example, of an electric motor 114 having a threaded motor shaft 116, is seated in the motor receptacle 104, wherein the electric motor is prevented from rotating in the motor receptacle, as for example by a non-circular mutual engagement or by a key-slot interference 118. The electric motor 114 may be preferably a stepper motor having conventional circuitry associated therewith which remembers the absolute rotational position of the threaded motor shaft 116. Wiring 120 from the electric motor 114 exits the fan shaft 102 in the form of external rings 122 which are affixed to the fan shaft. Conventional brush contacts 122*b* slide on the slip ring to thereby electrically connect the electric motor to a conventional external electric power circuit (not shown).

The drive component 112 is drivingly engaged with respect to a follower component 130. The follower component 130 includes a pedestal 132 having axially aligned splines 134 on its periphery. The follower component 130 further has an axially aligned threaded bore 136. The pedestal 132 is received in the follower receptacle 106, wherein the two sets of splines 110, 134 mutually mesh, allowing mutual axial sliding without rotation as the threaded motor shaft 116 is threadingly engaged with respect to the threaded bore 136. In this regard, actuation of the electric motor 114 in one direction results in the follower component 130 moving axially away from the electric motor, while rotation of the electric motor in the opposite direction results in the follower component moving toward the electric motor.

The follower component 130 further includes a head 138. A plurality of fan blades 140 are resiliently attached to the head 138. The preferred attachment is via a torsion bar 142 non-rotatingly anchored at one end in radial or, more preferably, tangential (as shown), disposition of the head 138 and non-rotatingly anchored at the other end in, preferably, bisecting disposition to an inside end 140*i* of its respective fan blade 140 so that a torque moment is established between the torsion bar and the push rod. The torsion bars 142 each have a pre-loaded torsional bias, as will be described momentarily.

The drive component 112 in combination with the follower component 130 provide, collectively, a linear actuator 148.

A push assembly 150 is connected to the proximal end 102*e* of the fan shaft 102 (i.e., at the end of the proximal end portion 102*p*), being composed of a push plate 152 and a plurality of upstanding (axially aligned) push rods 154, there being one push rod, respectively, for each fan blade 140. Each push rod 154 engages its respective fan blade adjacent a contact edge 140*e* thereof, all engaging at either the leading edge 140*el* or following edge 140*ef*. The aforementioned torsional biasing TB of the torsion bars 142 (see FIG. 3A) is such that the contact edge 140*e* of each fan blade is resiliently biased into abutment with the rod end 154*e* of its respective push rod such that axial movement of the push rods (via the above described linear actuator 148) results in resiliently compliant changes of pitch of the blades.

With particular reference to FIGS. 3 through 5A, operation of the variable pitch fan blade mechanism 100 will now be detailed.

Figure 3:
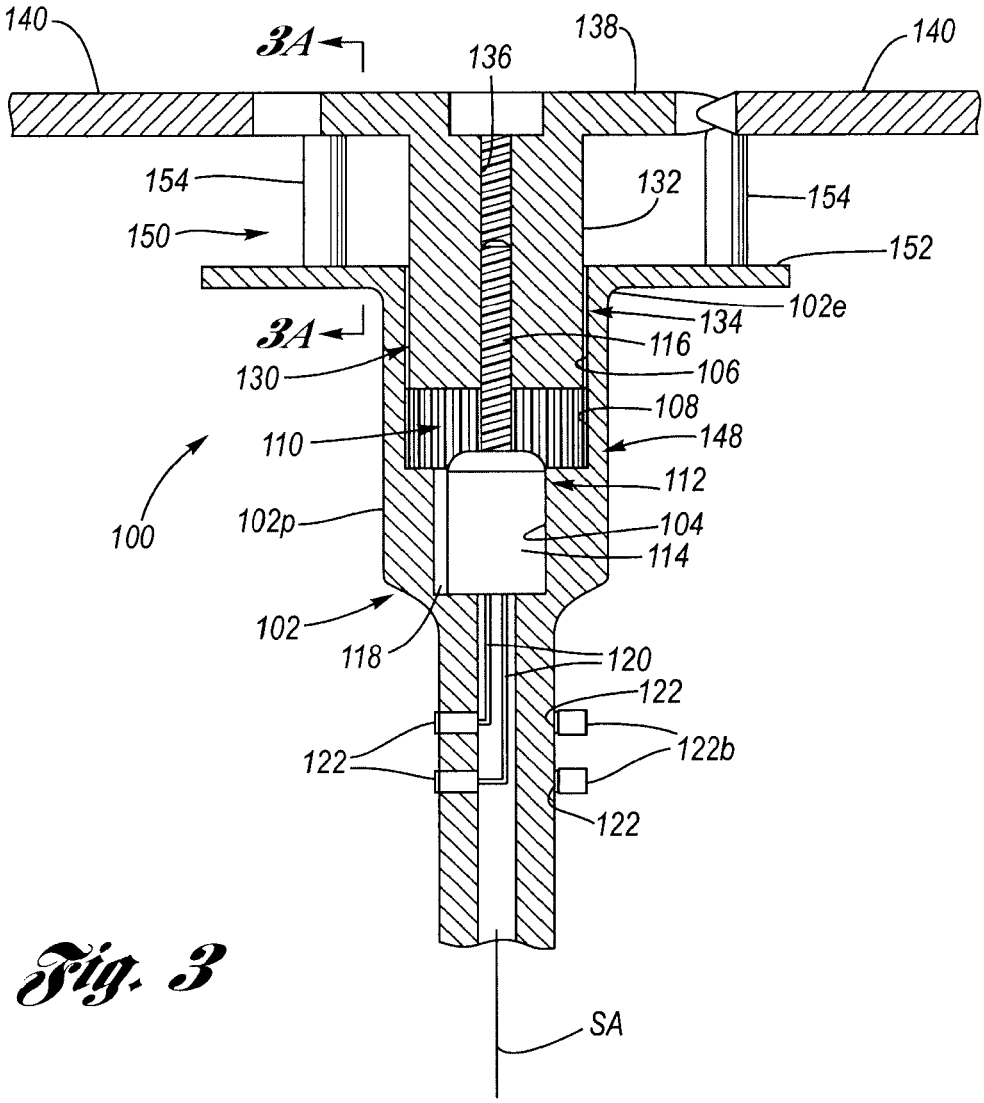
FIG. 3 is a partly sectional side view of the variable pitch fan blade mechanism according to the present invention, wherein the fan blades have a neutral pitch.
Figure 3A:
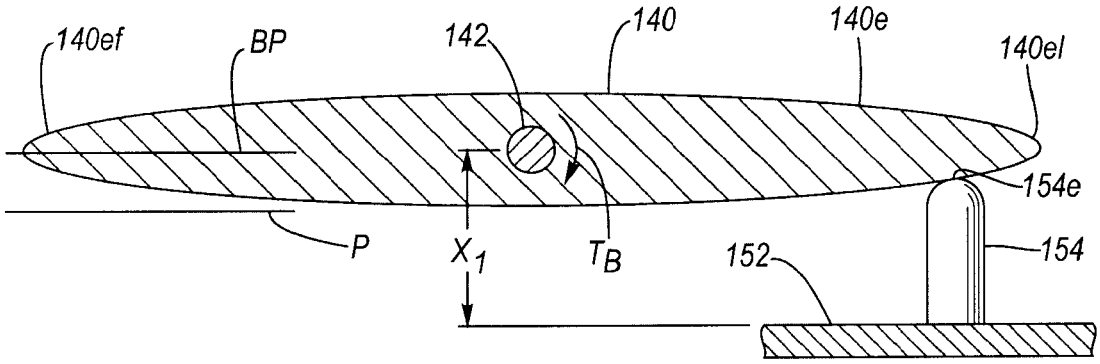
FIG. 3A is a partly sectional side view of a fan blade and its respective push rod, seen along line 3A-3A of FIG. 3.

It is seen in FIGS. 3 and 3A, merely by exemplary reference, that the linear actuator 148 has provided a neutral pitch to the fan blades 140, wherein by "neutral pitch" is meant that the fan blades have a blade pitch BP which is oriented parallel to the plane of rotation P (which is, itself, axially normal to the fan shaft axis SA) whereby rotation of the fan shaft results in no axial forced air movement. At this orientation, the center of each of the torsion bars 142 is spaced a distance $X_1$ from the push plate 152.

Figure 4:
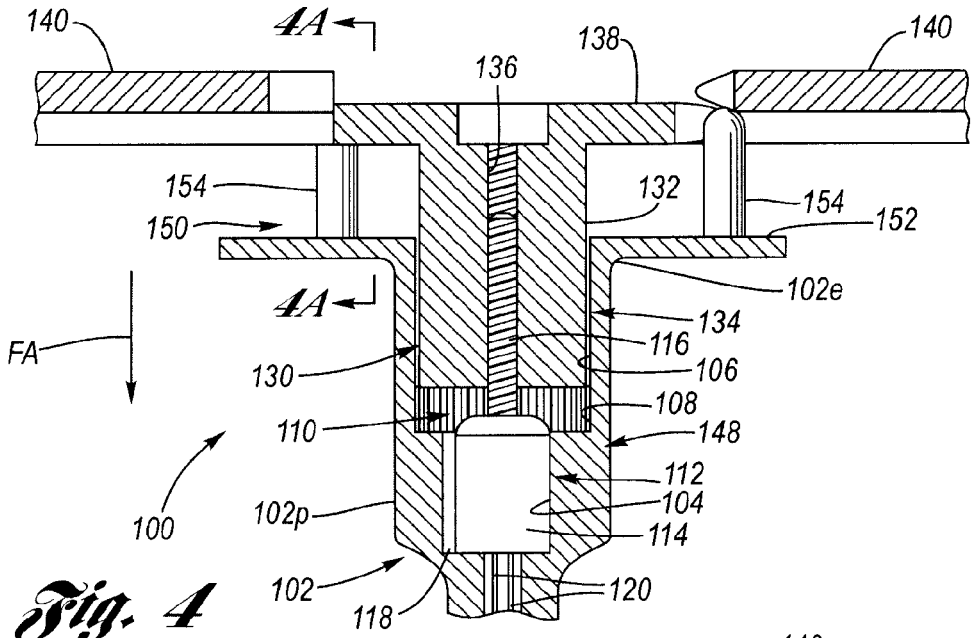
FIG. 4 is a partly sectional side view of the variable pitch fan blade mechanism according to the present invention, wherein the fan blades have a positive pitch.
Figure 4A:
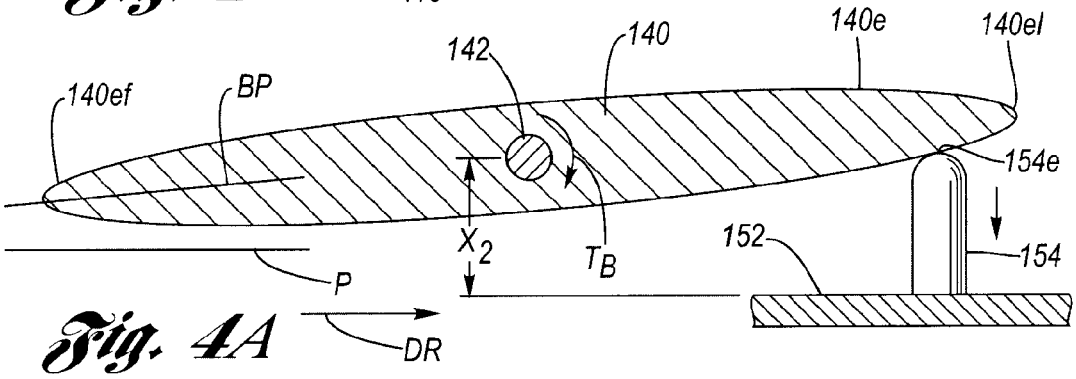
FIG. 4A is a partly sectional side view of a fan blade and its respective push rod, seen along line 4A-4A of FIG. 4.

Referring next to FIGS. 4 and 4A, the electric motor 114 has been actuated, whereby the threaded motor shaft 116 has threaded in the threaded bore 136 so as to thereby move the follower component 130 with respect to the push plate 152 from the position shown at FIG. 3 to that shown at FIG. 4. Electric power to the electric motor 114 through the rings 122 is only provided during the time the threaded motor shaft threads in the threaded bore. As a consequence of this axial movement of the follower component (and its push plate), the push rods have caused increased resilient tilting of the fan blades as compared to that of FIG. 3 so as to thereby compliantly change the blade pitch.

In this regard, the linear actuator 148 has been actuated so as to cause the push rods 154 to impart a positive pitch to the fan blades, wherein by "positive pitch" is meant that the blade pitch is acutely angled with respect to the plane of rotation P and direction of rotation (see arrow DR), whereby rotation of the fan shaft results in forced air movement axially toward the distal end of the fan shaft (see arrow FA). At this orientation, the center of each of the torsion bars 142 is spaced a distance $X_2$ from the push plate 152. This movement of the push plate relative to the fan blades causes an increase in the torsional biasing of the torsion bars.

Figure 5:
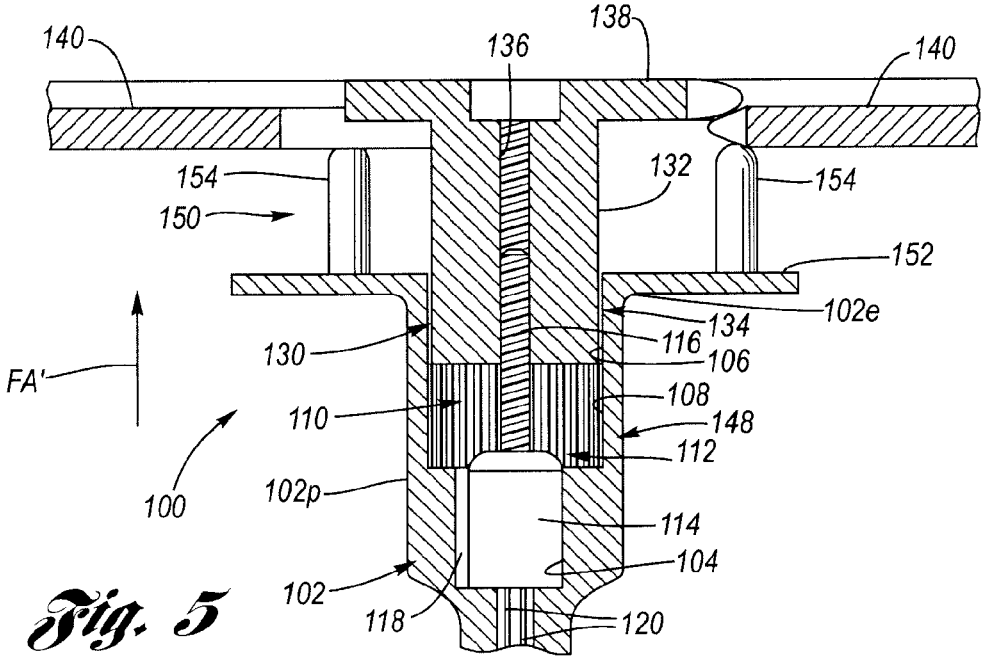
FIG. 5 is a partly sectional side view of the variable pitch fan blade mechanism according to the present invention, wherein the fan blades have a negative pitch.
Figure 5A:
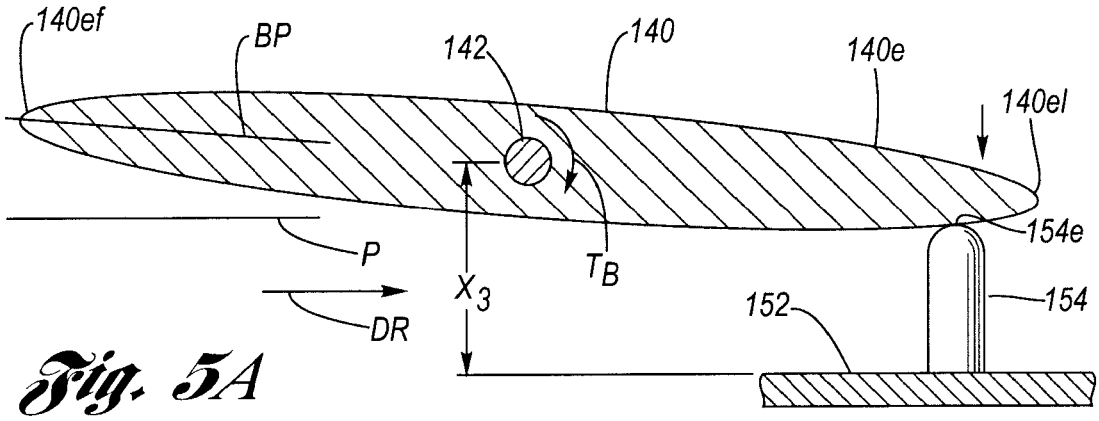
FIG. 5A is a partly sectional side view of a fan blade and its respective push rod, seen along line 5A-5A of FIG. 5.

Referring next to FIGS. 5 and 5A, the electric motor 114 has been actuated, whereby the threaded motor shaft 116 has threaded in the threaded bore 136 (in the opposite rotational direction for that used to go from FIG. 3 to FIG. 4 as recounted immediately above) so as to thereby move the follower component 130 with respect to the push plate from the position shown at FIG. 3 to that shown at FIG. 5. Again, electric power to the electric motor through the rings 122 is only provided during the time the threaded motor shaft threads in the threaded bore. As a consequence of this axial movement of the follower component (and its push plate), the push rods cause decreased resilient tilting of the fan blades as compared to that of FIG. 3 so as to thereby compliantly change the blade pitch.

In this regard, the linear actuator 148 has been actuated so as to cause the push rods 154 to impart a negative pitch to the fan blades, where by "negative pitch" is meant that the blade pitch is acutely angled with respect to the plane of rotation P and direction of rotation (see arrow DR), whereby rotation of the fan shaft results in forced air movement axially away from the distal end of the fan shaft (see arrow FA'). At this orientation, the center of each of the torsion bars 142 is spaced a distance $X_3$ from the push plate 152. This movement of the push plate relative to the fan blades causes a decrease in the resilient torsional biasing of the torsion bars, yet the torsional biasing is still strongly biasing the fan blade edge toward the always abutting push rod end.

From the foregoing description, it is clear that the fan blades may be made to compliantly change blade pitch to any amount of increasing/decreasing positive pitch and/or increasing/decreasing negative pitch, and that electric power is only needed during pitch change (and this is the case whether the fan shaft rotates clockwise or counter-clockwise).

Figure 6:
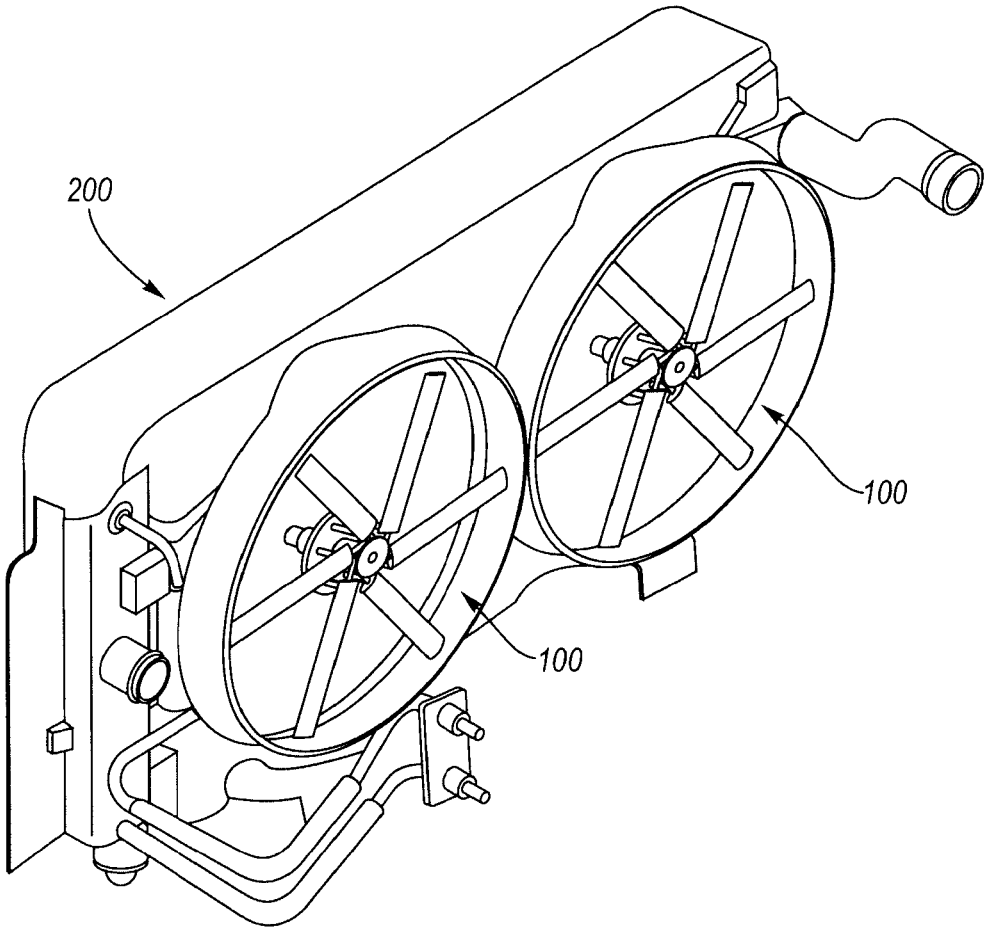
FIG. 6 is a perspective view of a fan assembly of the type used for automotive applications, wherein a pair of fans are equipped with the variable pitch fan blade mechanism according to the present invention.

FIG. 6 depicts an automotive application of the variable pitch fan blade mechanism 100, implemented as a fan assembly 200 analogous to that shown at FIG. 1. In an automotive application, the variable pitch fan blade mechanism 100 according to the present invention increases fuel economy by eliminating the losses inherent in variable speed electric fans or in viscous-clutch engine driven fans, and by allowing for decreased fan work at high vehicles speeds when air flows are inherently higher. Fan work can essentially be adjusted to the powertrain cooling needs, thus optimizing fan work and preventing parasitic energy loss.

To those skilled in the art to which this invention appertains, the above described preferred embodiment may be subject to change or modification. Such change or modification can be carried out without departing from the scope of the invention, which is intended to be limited only by the scope of the appended claims.

The invention claimed is:

1. A variable pitch fan blade mechanism, comprising:

a fan shaft having a proximal end portion;

a linear actuator connected with said fan shaft at said proximal end thereof, said linear actuator comprising a drive component seated in said fan shaft and a follower component slidably movable axially with respect to said fan shaft responsive to actuation of said linear actuator;

a plurality of push rods connected to said fan shaft; and a plurality of fan blades connected to said follower component, each push rod abutting a respective fan blade, wherein each fan blade is resiliently biased toward its respective push rod;

wherein actuation of said linear actuator results in said follower component moving in relation to said fan shaft such that each said fan blade moves in relation to its respective push rod such that a blade pitch of each said fan blade is compliantly changed with respect to a blade rotation plane.

2. The variable pitch fan blade mechanism of claim 1, wherein:

said drive component further comprises:

a motor receptacle formed in said proximal end portion of said fan shaft;

an electric motor non-rotatably seated in said motor receptacle, said electric motor having a threaded motor shaft; and a follower receptacle formed in said fan shaft in communicating relation to said motor receptacle, said follower receptacle having a splined sidewall; and said follower component further comprises:

a splined pedestal meshed with said splined sidewall so that said pedestal is non-rotatably slidable axially with respect to said fan shaft, said pedestal having a threaded bore into which said threaded motor shaft is threaded, wherein actuation of said motor causes said follower to axially slide in said follower receptacle; and a head connected to said pedestal, wherein said fan blades are connected to said head.

3. The variable pitch fan blade mechanism of claim 2, further comprising:

a push plate connected to said proximal end portion of said fan shaft, wherein said push rods are connected to said push plate in upstanding relation thereto.

4. The variable pitch fan blade mechanism of claim 2, further comprising:

a plurality of torsion bars, each torsion bar connecting an inside end of a respective fan blade to said head, wherein each torsion bar has a torsional bias which resiliently biases its respective fan blade abuttingly toward its respective push rod; and wherein each push rod abuts its respective fan blade adjacent an edge thereof so as to establish a torque moment with respect to the push rod.

5. The variable pitch fan blade mechanism of claim 4, further comprising:

a push plate connected to said proximal end portion of said fan shaft, wherein said push rods are connected to said push plate in upstanding relation thereto.

6. The variable pitch fan blade mechanism of claim 4, wherein each said torsion bar is connected to said head in tangential relation thereto.

7. The variable pitch fan blade mechanism of claim 6, further comprising:

a push plate connected to said proximal end portion of said fan shaft, wherein said push rods are connected to said push plate in upstanding relation thereto.

8. A fan assembly comprising at least one fan, wherein each fan comprises:

a fan shaft having a proximal end portion;

a plurality of fan blades rotatively driven by said fan shaft; and a variable pitch fan blade mechanism, comprising:

a linear actuator connected with said fan shaft at said proximal end thereof, said linear actuator comprising a drive component seated in said fan shaft and a follower component slidably movable axially with respect to said fan shaft responsive to actuation of said linear actuator; and a plurality of push rods connected to said fan shaft, wherein said plurality of fan blades are connected to said follower component, each push rod abutting a respective fan blade, wherein each fan blade is resiliently biased toward its respective push rod;

wherein actuation of said linear actuator results in said follower component moving in relation to said fan shaft such that each said fan blade moves in relation to its respective push rod such that a blade pitch of each said fan blade is compliantly changed with respect to a blade rotation plane.

9. The fan assembly of claim 8, wherein:

said drive component further comprises:

a motor receptacle formed in said proximal end portion of said fan shaft;

an electric motor non-rotatably seated in said motor receptacle, said electric motor having a threaded motor shaft; and a follower receptacle formed in said fan shaft in communicating relation to sad motor receptacle, said follower receptacle having a splined sidewall; and said follower component further comprises:

a splined pedestal meshed with said splined sidewall so that said pedestal is non-rotatably slidable axially with respect to said fan shaft, said pedestal having a threaded bore into which said threaded motor shaft is threaded, wherein actuation of said motor causes said follower to axially slide in said follower receptacle; and a head connected to said pedestal, wherein said fan blades are connected to said head.

10. The fan assembly of claim 9, further comprising:

a push plate connected to said proximal end portion of said fan shaft, wherein said push rods are connected to said push plate in upstanding relation thereto.

11. The fan assembly of claim 9, further comprising:

a plurality of torsion bars, each torsion bar connecting an inside end of a respective fan blade to said head, wherein each torsion bar has a torsional bias which resiliently biases its respective fan blade abuttingly toward its respective push rod; and wherein each push rod abuts its respective fan blade adjacent an edge thereof so as to establish a torque moment with respect to the push rod.

12. The fan assembly of claim 11, further comprising:

a push plate connected to said proximal end portion of said fan shaft, wherein said push rods are connected to said push plate in upstanding relation thereto.

13. The fan assembly of claim 11, wherein each said torsion bar is connected to said head in tangential relation thereto.

14. The fan assembly of claim 13, further comprising:

a push plate connected to said proximal end portion of said fan shaft, wherein said push rods are connected to said push plate in upstanding relation thereto.

* * * * *